US010135150B2

(12) United States Patent
Legay et al.

(10) Patent No.: US 10,135,150 B2
(45) Date of Patent: Nov. 20, 2018

(54) QUASI-OPTICAL BEAMFORMER WITH LENS AND PLANE ANTENNA COMPRISING SUCH A BEAMFORMER

(71) Applicants: THALES, Courbevoie (FR); UNIVERSITE DE RENNES 1, Rennes (FR); CENTRE NATIONAL DE LA RECHERCHE SCIENTIFIQUE, Paris (FR)

(72) Inventors: Hervé Legay, Plaisance du Touch (FR); Ségolène Tubau, Toulouse (FR); Jean-Philippe Fraysse, Toulouse (FR); Etienne Girard, Plaisance du Touch (FR); Mauro Ettorre, Rennes (FR); Ronan Sauleau, Acigne (FR); Nelson Fonseca, Noordwijk (NL)

(73) Assignees: THALES, Courbevoie (FR); UNIVERSITE DE RENNES 1, Rennes (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 346 days.

(21) Appl. No.: 15/194,993

(22) Filed: Jun. 28, 2016

(65) Prior Publication Data

US 2017/0005407 A1 Jan. 5, 2017

(30) Foreign Application Priority Data

Jul. 3, 2015 (FR) ..... 15 01415

(51) Int. Cl.
*H01Q 15/04* (2006.01)
*H01Q 15/10* (2006.01)
(Continued)

(52) U.S. Cl.
CPC ..... *H01Q 15/04* (2013.01); *H01Q 3/2658* (2013.01); *H01Q 3/2664* (2013.01); *H01Q 15/02* (2013.01);
(Continued)

(58) Field of Classification Search
CPC ..... H01Q 19/06; H01Q 19/062; H01Q 19/08; H01Q 3/2658; H01Q 21/0031; H01Q 15/10; H01Q 15/02; H01Q 15/04
See application file for complete search history.

(56) References Cited

U.S. PATENT DOCUMENTS 2,747,184 A * 5/1956 Kock ..... H01P 1/20 333/208
3,170,158 A 2/1965 Rotman
(Continued)

FOREIGN PATENT DOCUMENTS

FR 2 944 153 A1 10/2010
FR 2 986 377 A1 8/2013

*Primary Examiner* — Gregory C. Issing
(74) *Attorney, Agent, or Firm* — Baker & Hostetler LLP

(57) ABSTRACT

A beamformer comprises a transmission line fed by at least one input feed source, the transmission line comprising two stacked metal plates extending, along two directions, longitudinal X and transverse Y. The transmission line further comprises at least one protuberance extending in the directions X, Y, and in a direction Z orthogonal to the plane XY, the protuberance comprising a metal insert extending in the directions X and Y and extending height-wise in the direction Z, the insert comprising a base fastened to one of the two metal plates and a free end and having a contour of variable length between the two lateral edges of the transmission line. In the protuberance, the transmission line is adjoining the insert and forms, in the direction Z, a circumvolution around the insert.

21 Claims, 13 Drawing Sheets

(51) Int. Cl.

| | |
|---|---|
| ***H01Q 19/08*** | (2006.01) |
| ***H01Q 25/00*** | (2006.01) |
| ***H01Q 3/26*** | (2006.01) |
| ***H01Q 21/00*** | (2006.01) |
| ***H01Q 15/02*** | (2006.01) |

(52) U.S. Cl.
CPC ..... *H01Q 15/10* (2013.01); *H01Q 19/08* (2013.01); *H01Q 21/0031* (2013.01); *H01Q 25/008* (2013.01)

(56) References Cited

U.S. PATENT DOCUMENTS

| | | | |
|---|---|---|---|
| 5,926,134 | A | 7/1999 | Pons et al. |
| 5,936,588 | A | 8/1999 | Rao et al. |
| 6,160,520 | A | 12/2000 | Muhlhauser et al. |
| 2017/0084971 | A1* | 3/2017 | Kildal ..... H01P 1/2005 |

* cited by examiner

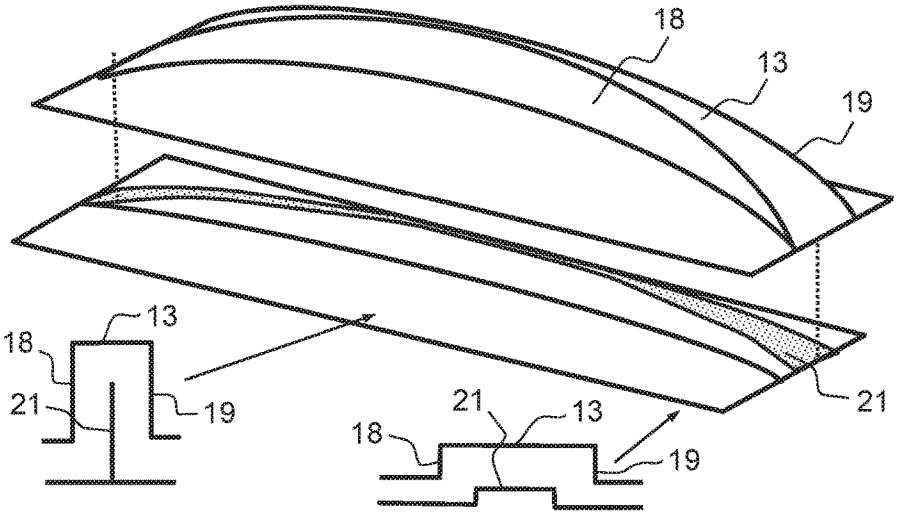
FIG.3a
FIG.3b
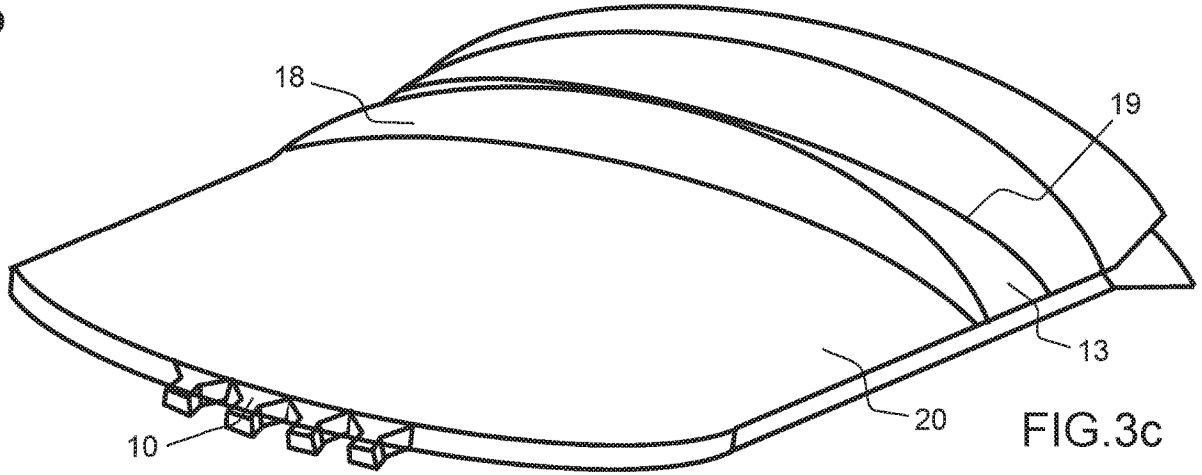
FIG.3c

QUASI-OPTICAL BEAMFORMER WITH LENS AND PLANE ANTENNA COMPRISING SUCH A BEAMFORMER

CROSS-REFERENCE TO RELATED APPLICATIONS

This application claims priority to foreign French patent application No. FR 1501415, filed on Jul. 3, 2015, the disclosures of which are incorporated by reference in their entirety.

FIELD OF THE INVENTION

The present invention relates to a quasi-optical beamformer with lens and a plane antenna comprising such a beamformer. It applies to any multibeam antenna of small thickness and more particularly to the field of space applications such as satellite telecommunications, for antennas intended to be mounted aboard satellites, or for antennas intended to be used on the ground on fixed or mobile terminals.

To facilitate the description, the beamformers are assumed to be operating in transmit mode, but a similar description could be formulated in receive mode, the beamformers considered being passive, and therefore reciprocal, elements.

BACKGROUND

Beamformers are used in multibeam antennas to produce output beams on the basis of radiofrequency input signals. In a known manner, there exist planar quasi-optical beamformers using electromagnetic propagation of radiofrequency waves between two parallel metal plates, in general according to a TEM (Transverse Electric Magnetic) mode of propagation for which the electric and magnetic fields are orthogonal to the direction of propagation of the radiofrequency waves. The TEM mode propagates in the parallel-plate guide at the same speed as in vacuo, thus rendering the said guide non-dispersive for this TEM mode. The focusing and collimation of the beams can be carried out by a constrained lens, as for example described in documents U.S. Pat. No. 3,170,158 and U.S. Pat. No. 5,936,588 which illustrate the case of a Rotman lens, or alternatively by a reflector as described for example in documents FR 2944153 and FR 2 986377 for Pillbox beamformers, the constrained lens, or respectively the reflector, being inserted on the propagation path of the radiofrequency waves, between the two parallel metal plates. The constrained lens, or the reflector, serves essentially as phase corrector and makes it possible, by transmission in the case of a lens, or after reflection in the case of a reflector, to convert cylindrical wavefronts into plane wavefronts.

A Pillbox beamformer can, at output, be connected to a linear array of several individual radiating elements aligned side by side. As an alternative to the use of several individual radiating elements, it is also possible to connect the linear output aperture, situated between the two parallel plates, to a single linear output horn which produces the transition between the parallel plates and the free space where the beams are radiated. In the case of the use of a single linear horn, the radiating aperture at the output of the Pillbox beamformer is linear and extends continuously over the whole transverse width of the parallel plates. These radiating linear apertures, which are not spatially quantized, have much higher performance with respect to linear arrays of several radiating elements, for beams which are squinted with respect to the focal axis, because of the absence of quantization, and exhibit a much greater bandwidth because of the absence of resonant propagation modes. However, a Pillbox beamformer exhibits the drawback of giving rise to degraded beams when the excitation sources are remote from the focus of the reflector integrated between the parallel plates.

In beamformers of the type with constrained lenses, such as Ruze or Rotman lenses, the radiofrequency waves are constrained, that is to say guided, along a propagation path not corresponding to a natural optical path, in free space, such as defined by the Snell-Descartes laws. These beamformers can be synthesized so as to exhibit three or four different foci, thereby making it possible to obtain fewer aberrations and beams of better quality. However to control the delays of the radiofrequency waves propagating towards the lateral edges of the lens with respect to those propagating in an axial direction, towards the centre of the lens, these beamformers make it necessary for the radiofrequency waves to be tapped off along the internal contour of the lens by an array of various delay transmission lines. These delay transmission lines are distributed over the said internal contour of the lens and are connected to corresponding radiating elements whose ports define the external contour of the lens. The problem is that tapping off the radiofrequency waves disturbs the electromagnetic field which is sampled spatially and induces losses. Moreover, in order for the constrained-lens beamformer to be planar and for the lens to be completely integrated between the two parallel plates, it is necessary to add, over the path of the radiofrequency waves, delay transmission lines, for example rectangular waveguides, which induce a frequency dispersion and limit the bandwidth of the beamformer. To avoid frequency dispersion and to increase the bandwidth, in certain Rotman lenses, the transmission lines used are coaxial lines, but this requires the fashioning of a transition between the coaxial lines and the linear radiating aperture, and the structure of the beamformer is then not completely integrated. No solution currently exist for a beamformer of constrained lens type making it possible to circumvent the sampling of the radiofrequency waves.

SUMMARY OF THE INVENTION

The aim of the invention is to produce a new quasi-optical beamformer with lens making it possible to convert cylindrical wavefronts into plane wavefronts by applying differential delays between the centre and the lateral edges of the lens, not exhibiting the drawbacks of known constrained-lens beamformers, making it possible to circumvent the spatial sampling of the radiofrequency waves, and allowing the use of a single linear output horn.

Therefore, according to the invention, the quasi-optical beamformer with lens comprises a radiofrequency transmission line fed at a first end, by at least one input feed source, the transmission line comprising two stacked metal plates, spaced apart and extending in two directions, longitudinal X and transverse Y. The transmission line furthermore comprises at least one protuberance extending in the directions X, Y, and in a direction Z orthogonal to the plane XY, the protuberance comprising a metal insert extending in the direction X, in the transverse direction Y between two lateral edges of the lens, and extending height-wise in the direction Z. The metal insert comprises a base fastened to one of the two metal plates, at least one free end and has, in longitudinal section, a contour of variable length between the two lateral edges of the transmission line. In the protuberance, the transmission line is adjoining the metal insert and forms, in the direction Z, a circumvolution around the metal insert.

Advantageously, the free end of the insert can be folded back parallel to the plane XY.

Advantageously, the free end of the insert can be doubly folded back in a T shape, parallel to the plane XY.

Advantageously, the protuberance and the metal insert can have a curvilinear-shaped profile in the directions X and Y.

Advantageously, the protuberance can have an input profile and an output profile of different shapes.

Advantageously, the protuberance can comprise matching stubs.

Advantageously, in the protuberance, the metal plates of the transmission line can have an internal face comprising staircase-like transitions.

Advantageously, in the case of a convergent lens, the length of the contour of the metal insert can decrease progressively from the centre to the two lateral edges of the transmission line.

Alternatively, in the case of a divergent lens, the length of the contour, in longitudinal section, of the metal insert can increase progressively from the centre to the two lateral edges of the transmission line.

Advantageously, the metal insert can comprise a symmetric profile with respect to the median longitudinal axis of the transmission line.

Advantageously, the lens can comprise several input feed sources distributed around an input edge, according to a focal curve.

Advantageously, the beamformer can comprise several protuberances able to produce progressive delays, the protuberances being distributed successively along the longitudinal axis X of the transmission line, at various distances from the input feed sources, each protuberance comprising a metal insert, the length of whose contour, in longitudinal section, varies between the two lateral edges of the transmission line.

Advantageously, the length of the contour of the metal inserts, in the various successive protuberances, can vary progressively from one protuberance to another adjacent protuberance, in the longitudinal direction X of the transmission line.

Advantageously, the transmission line can be folded back on itself in the direction X, according to a fold of straight shape.

Advantageously, the beamformer can furthermore comprise at least one first reflector wall extending transversely in the transmission line, and orthogonally to the metal plates in the direction Z, the first reflector wall being able to fold the transmission line, back on itself, in the direction X, according to a fold of curvilinear shape.

Advantageously, the quasi-optical beamformer with lens can comprise two stacked layers closed at one end by the first reflector wall and two opposite protuberances fashioned around a metal insert extending in the two stacked layers, the first reflector wall being integrated into the two opposite protuberances.

Advantageously, the quasi-optical beamformer with lens can furthermore comprise a third layer stacked on the second layer and a second reflector wall extending in the second and third layers.

Advantageously, the quasi-optical beamformer with lens can furthermore comprise at least one third protuberance fashioned in the second layer downstream of the first reflector wall.

The invention also relates to a plane antenna comprising at least one such beamformer and furthermore comprising a linear radiating horn connected at output of the beamformer.

The invention relates finally to a plane antenna comprising such a beamformer, the transmission line being folded back on itself and comprising a linear output aperture linked to an array of several radiating horns.

BRIEF DESCRIPTION OF THE DRAWINGS

Other particularities and advantages of the invention will be clearly apparent in the subsequent description given by way of purely illustrative and nonlimiting example, with reference to the appended schematic drawings which represent:

FIG. 3*a*: an exploded diagram, in perspective, of an exemplary protuberance in which the insert has a height varying in the direction Z and a thickness varying in the direction X, according to a variant of the invention;

FIG. 3*b*: two diagrams, in longitudinal section, respectively at the centre of the lens and on the lateral edges of the lens, of the protuberance corresponding to the example of FIG. 3*a*, according to the invention;

FIG. 3*c*: a perspective diagram of the beamformer corresponding to FIGS. 3*a* and 3*b*, according to the invention;

DETAILED DESCRIPTION

Figure 1:
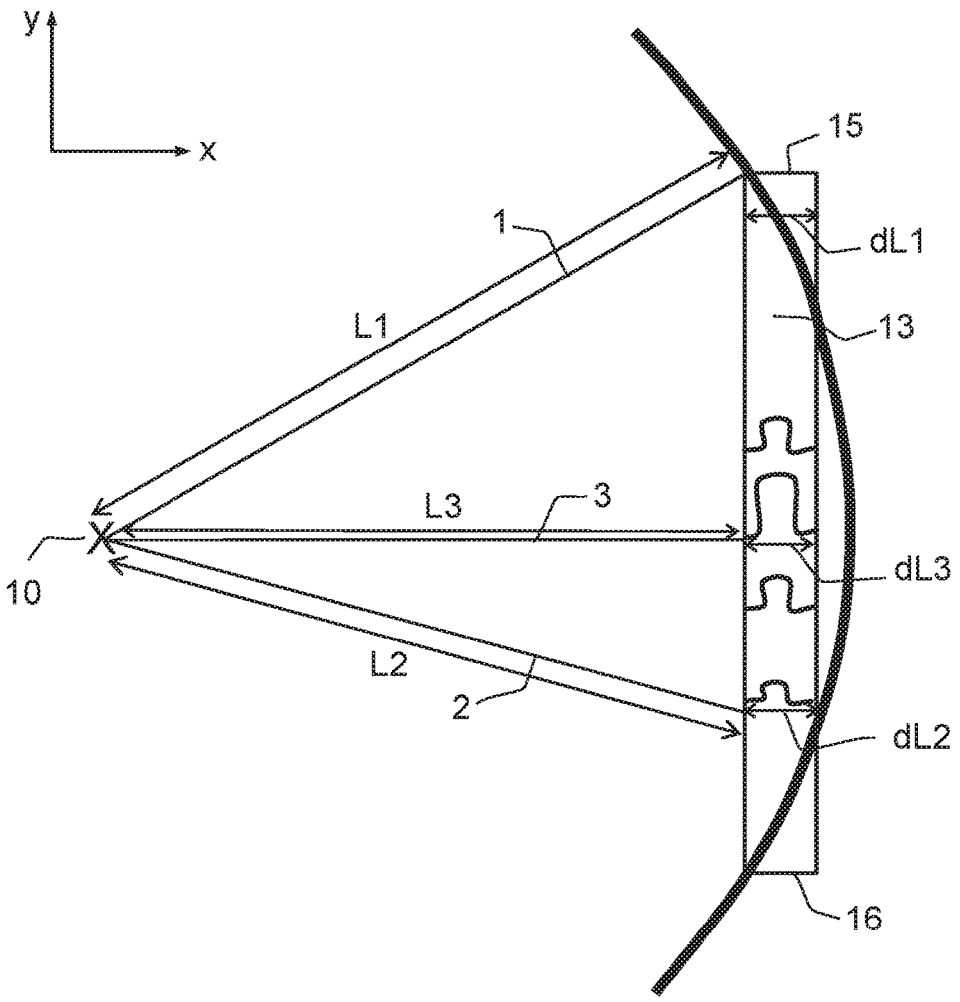
FIG. 1: a diagram illustrating the operating principle of a beamformer with lens with continuous and progressive delays, according to the invention.
Figure 2A:
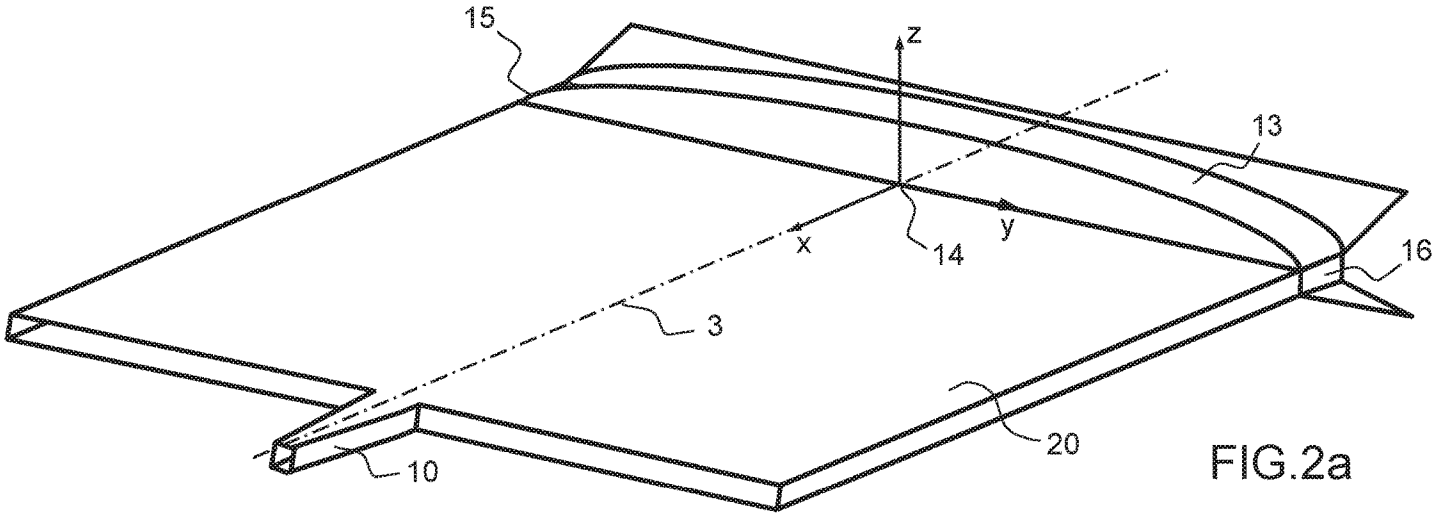
FIG. 2*a*: a perspective diagram of an exemplary beamformer with lens with continuous and progressive delays comprising a protuberance with plane profile, according to the invention.

In accordance with the invention, the beamformer with lens represented in the diagram of FIG. 1 and in the perspective view of FIG. 2*a* comprises a transmission line 20 with two metal plates and a lens with progressive and continuous delays between the centre 14 of the lens and the two lateral edges 15, 16. The transmission line 20 consists of two stacked metal plates, respectively upper and lower, spaced apart by a cavity, and extending in two directions, longitudinal X and transverse Y. The transmission line 20 is fed at a first end, by at least one input feed source 10 and is furnished with a protuberance 13, situated on the path of the radiofrequency waves. The input and output contours of the protuberance, which correspond respectively to the internal and external contours of the lens, can have profiles of identical and mutually parallel shapes or can have different profiles. The protuberance 13 extends thickness-wise in the direction X, transversely over the width of the transmission line in the direction Y, and height-wise in a direction Z orthogonal to the plane XY of the metal plates, the length dL1, dL2, dL3 of the transmission line in the protuberance varying from the centre 14 towards the two lateral edges 15, 16 of the lens, so as to apply a different delay to the radiofrequency waves propagating in the lens along paths 1, 2, 3 having different angular directions and different respective lengths L1, L2, L3. When the internal and external contours of the lens have profiles of identical shapes, the delay produced by the protuberance is proportional to the length of the transmission line, in the protuberance, over the path considered. In particular, when the internal and external contours of the lens have profiles of identical shapes, to produce a convergent lens, the delay applied to the radiofrequency waves propagating along the median longitudinal axis 3 of the lens, which corresponds to the shortest path, may be greater than the delays applied to all the other paths whilst the delay applied to the radiofrequency waves propagating towards the edges of the lens, which correspond to the longest paths, may be zero. In the case of a divergent lens, the law for the delays is different. When the internal and external contours of the lens have profiles of different shapes, the law for the delays is more complex since it also depends on the respective shapes of the said internal and external contours.

Figure 2B:
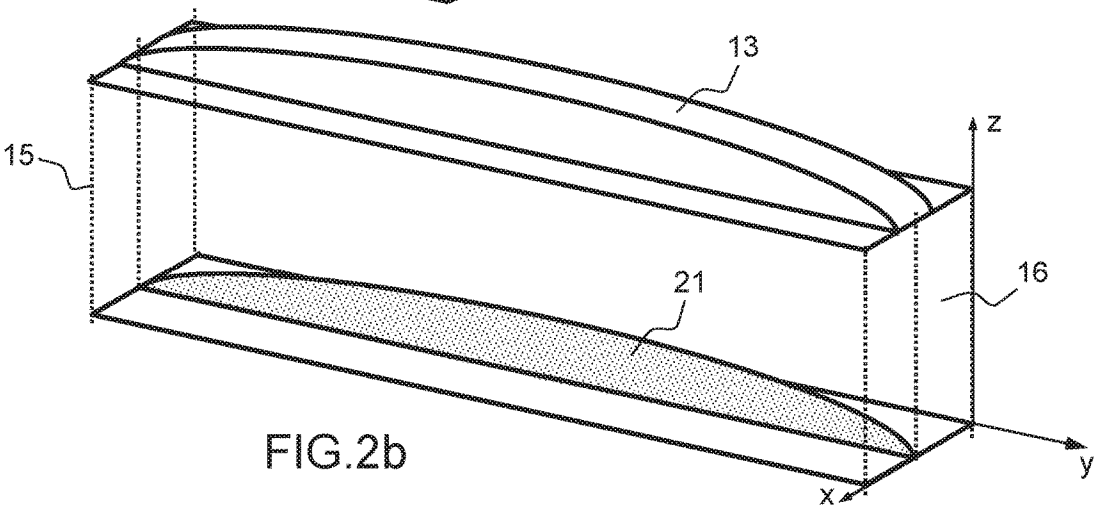
FIG. 2*b*: an exploded perspective diagram of the protuberance of FIG. 2*a*, according to the invention.

The protuberance 13 comprises a metal insert 21 housed transversely in the cavity, between the two metal plates, the insert 21, of arbitrary shape, comprising a base 21 b fastened to one of the two metal plates, lower or upper, for example the lower metal plate, and at least one free end 21 a. As represented in the exploded view of FIG. 2*b*, the metal insert 21 extends width-wise, in the transverse direction Y, between two lateral edges of the lens 15, 16, extends thickness-wise in the direction X, and extends height-wise, at least in part, in the direction Z. According to a longitudinal section of the transmission line, the insert 21 has an external contour of progressively varying length between the two lateral edges of the transmission line. The variation in the length of the contour of the insert 21 can be obtained by a variation in the height of the insert in the direction Z, or by a variation in the thickness of the insert in the direction X, or by a combination of a variation in height in the direction Z and of a variation in thickness in the direction X as illustrated for example in FIGS. 3*a*, 3*b*, 3*c*. FIG. 3*a* is an exploded perspective diagram of an exemplary protuberance in which the insert has a height varying in the direction Z and a thickness varying in the direction X. FIG. 3*b* shows two diagrams, in longitudinal section, respectively at the centre of the lens and on the lateral edges of the lens, of the protuberance of FIG. 3*a*. In this FIG. 3*b*, the insert has an I-shaped wall on the median longitudinal axis, at the centre of the lens, and has increased thickness and reduced height on the lateral edges of the lens. FIG. 3*c* is a perspective diagram of the beamformer corresponding to FIGS. 3*a* and 3*b*. In this example, as the thickness of the insert varies in the direction Y, between the two lateral edges of the lens, the input profile 18 and the output profile 19 of the protuberance 13, which correspond respectively to the internal and external contours of the lens, are not mutually parallel.

Figure 4A:
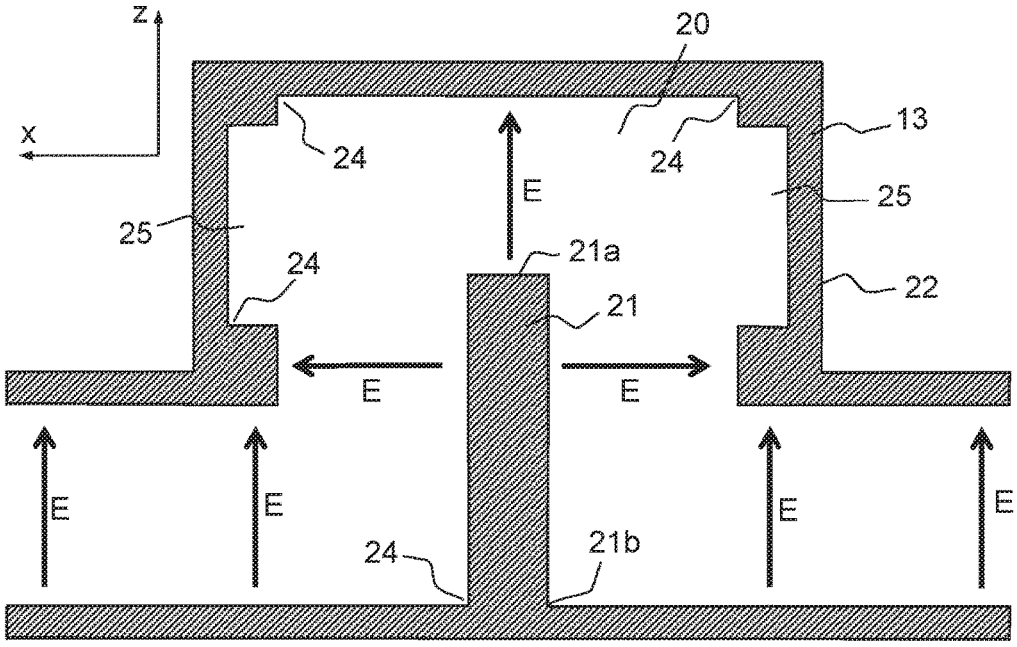
FIGS. 4*a*, 4*b*, 4*c*: three longitudinal sectional diagrams of a protuberance comprising a metal insert whose section is respectively I-shaped, L-shaped, T-shaped, the internal wall of the protuberance comprising right-angled changes of direction, according to first exemplary embodiments of the invention.

In the protuberance 13, the transmission line 20 is adjoining the metal insert 21 and therefore forms, in the direction Z, a circumvolution 22 around the metal insert 21, as represented for example in FIG. 4*a* for an insert having an I-shaped longitudinal section. The transmission line runs along the contour of the insert and therefore changes orientation several times but does not comprise any discontinuity of transmission. Thus, the transmission line follows the shape of the insert 21 continuously, lies alongside a first front surface, from the base 21*b* to the free end 21*a* of the insert, and then lies alongside a second rear surface, from the free end 21*a* to the base 21*a*. In the protuberance 13, the propagation of the electromagnetic waves is always carried out between two metal plates and according to the TEM propagation mode, the insert 21, placed in the middle of the protuberance, ensuring the role of the, lower or upper, metal plate to which its base is fastened. The direction of the electric field E in the transmission line rotates in the protuberance as a function of the orientation of the metal plates and remains, at all points of the transmission line, perpendicular to the metal plates, or almost perpendicular to the parallel plates when the metal plates are not exactly parallel.

The insert 21 placed on the path of the electromagnetic waves TEM, constitutes an obstacle to be circumvented which causes a propagation delay that is all the more significant the longer the contour of the insert. The law for the variation in the length of the contour of the insert, in a transverse direction of the lens, depends on the delay law desired for forming the beams.

The length of the contour of the metal insert can vary progressively from the centre of the lens, situated on the median longitudinal axis, up to the lateral edges of the lens, so as to compensate the disparity in journey time between the various paths and to obtain propagation paths of identical lengths over the whole width of the radiating output aperture of the lens.

In particular, when the internal and external contours of the lens have profiles of like shapes, the lens is convergent when the variation in the length of the contour of the insert decreases progressively from the centre to the two lateral edges of the transmission line. In this case, the length of the contour of the insert is significant at the centre of the lens and may be zero on the lateral edges of the lens. Conversely, the lens is divergent when the variation in the length of the contour of the insert increases progressively from the centre to the two lateral edges of the transmission line. To carry out a transformation of a cylindrical wave into a plane wave, a convergent lens is required. However, the association of a convergent lens and of a divergent lens may make it possible to minimize the phase aberrations over a wider angular sector, and therefore to form further beams.

Moreover, in the case of unformed beams, the length of the contour of the insert may for example vary symmetrically on either side of the median longitudinal axis of the lens.

Figure 4B:
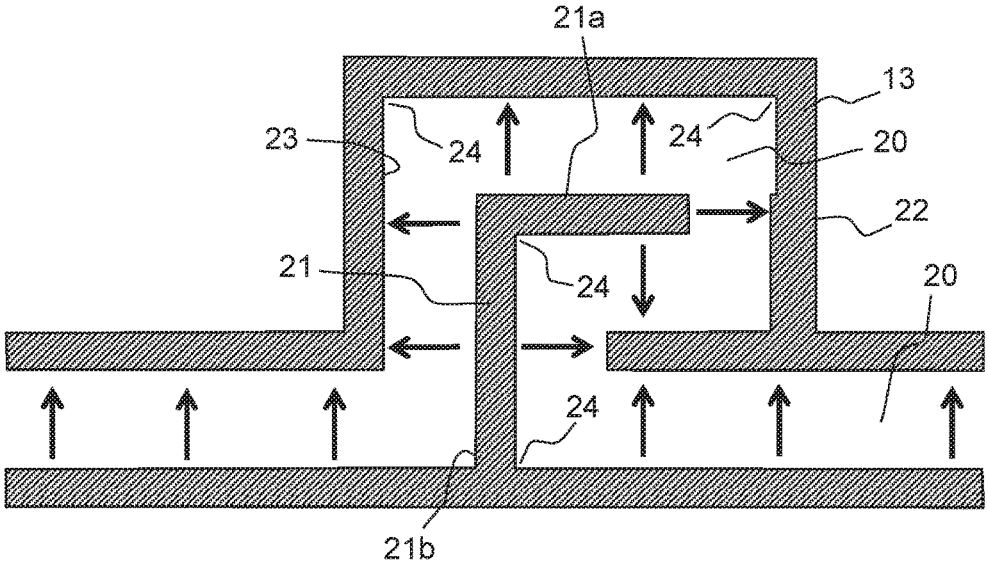
Figure 4C:
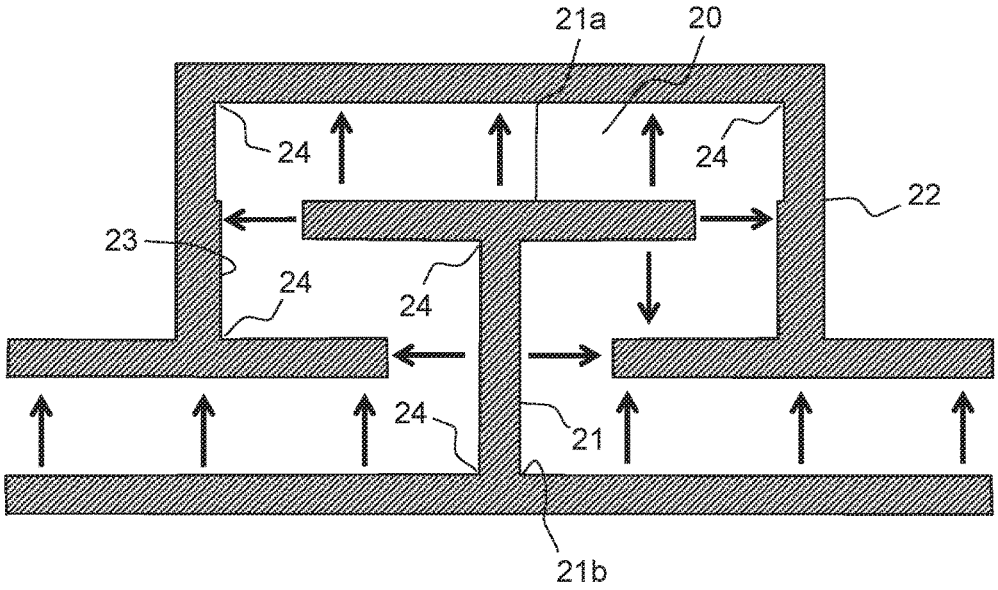
Figure 4D:
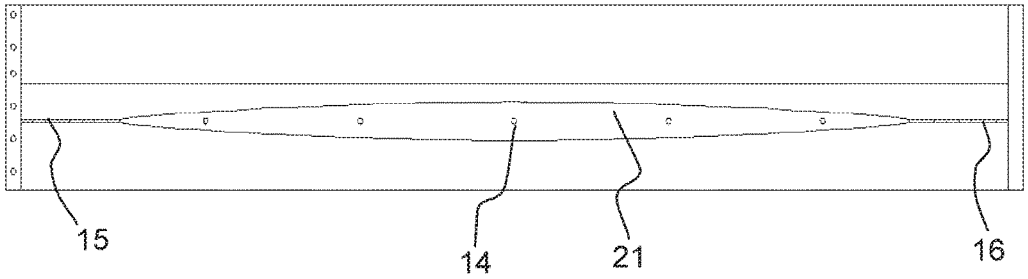
FIG. 4*d*: a view from above of the protuberance in the case where the insert is doubly folded back in a T shape, according to an embodiment of the invention.

The insert 21 can have various shapes. For example, when there is no thickness constraint on the beamformer, the insert can extend without limitation in the direction Z and have an I-shaped section over the whole width of the lens, as represented in FIG. 4*a*. When it is necessary to reduce the dimension of the protuberances, in the direction Z, to maintain a small thickness of the lens, for significant delays requiring insert heights that are greater than the desired thickness, to decrease the height of the insert without modifying the length of its contour, it is possible to fold back a free end 21*a*, opposite from the base 21*b*, of the insert parallel to the plane XY, the foldback being able to be simple or double as represented in the embodiments of FIGS. 4*b* and 4*c*, in which the insert 21 can have an L-shaped section when there is a simple foldback, or a T-shaped section when there is a double foldback. It is also possible to combine these various I-, L-, T-shapes, over the transverse width of the insert. In these three examples illustrated in FIGS. 4*a*, 4*b*, 4*c*, the metal insert 21 and the internal face 23 of the wall 22 of the protuberance 20 comprise right-angled transitions 24 corresponding, for the transmission line 20, to changes of direction of propagation from the direction Z to the direction X or conversely from the direction X to the direction Z. Of course, the foldback may not be necessary locally, on certain parts of the insert, for example on the lateral edges of the lens, when the local delays to be produced are small. For example, the length of the contour of the folded-back insert 21 may be larger on the median longitudinal axis 3, at the centre 14 of the lens, than on the other paths, as is shown by the view from above of FIG. 4*d*, and may then decrease progressively and symmetrically up to the two lateral edges 15, 16 of the lens where the foldback is no longer necessary.

Furthermore, in the protuberance, it is also possible to vary the thickness of the insert progressively, in the direction X, between the centre and the lateral edges of the lens as in FIGS. 4*a*, 4*b*, 4*c*. In this case, the input profile and output profile of the protuberance, which correspond to the internal and external contours of the lens, are of different shapes. This makes it possible to obtain an additional degree of freedom and thus to obtain fewer aberrations and beams of better quality.

To reduce the bulkiness of the transmission line in terms of thickness, in the direction Z, and to avoid the excitation of higher modes at the level of the protuberances, and especially when the insert is folded back, the separation distance between the parallel plates must be reduced at the level of the protuberances, so as typically to be less than a quarter of the guided wavelength corresponding to the highest frequency. To reduce the losses of the transmission line, the separation distance must on the contrary be a maximum. It is thus possible to vary the separation distance progressively from the input feed sources 10 up to the protuberances 13.

Figure 5A:
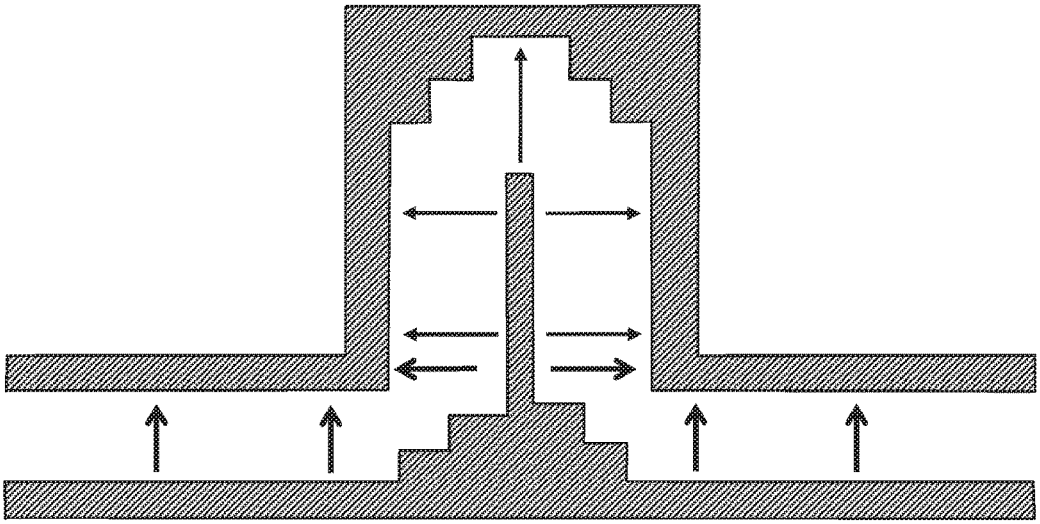
FIGS. 5*a*, 5*b*, 5*c*: three longitudinal sectional diagrams of a protuberance comprising a metal insert respectively I-shaped, L-shaped, T-shaped, the internal wall of the protuberance comprising staircase-like changes of direction, according to second exemplary embodiments of the invention.
Figure 5B:
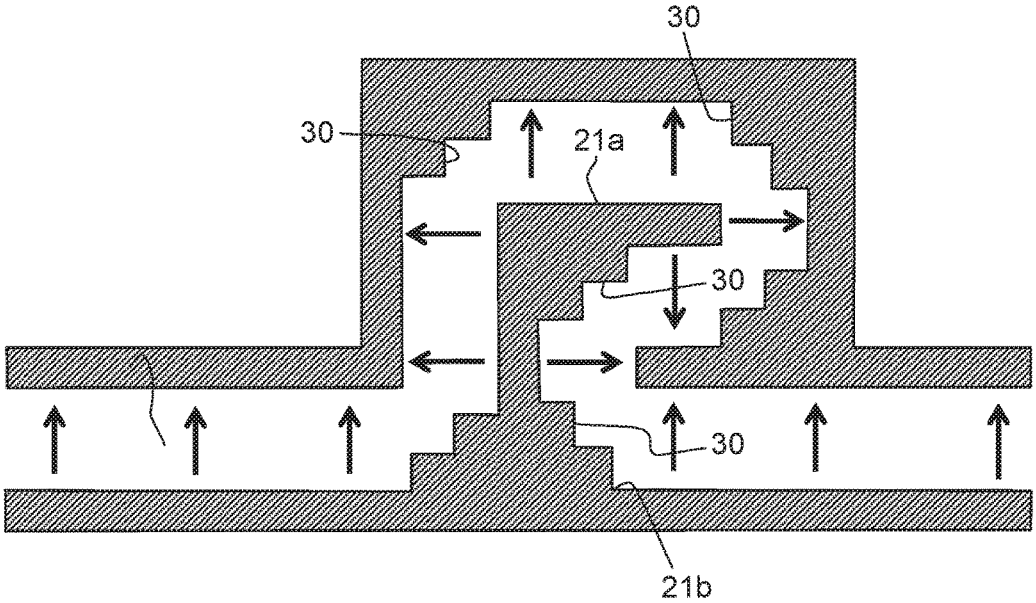
Figure 5C:
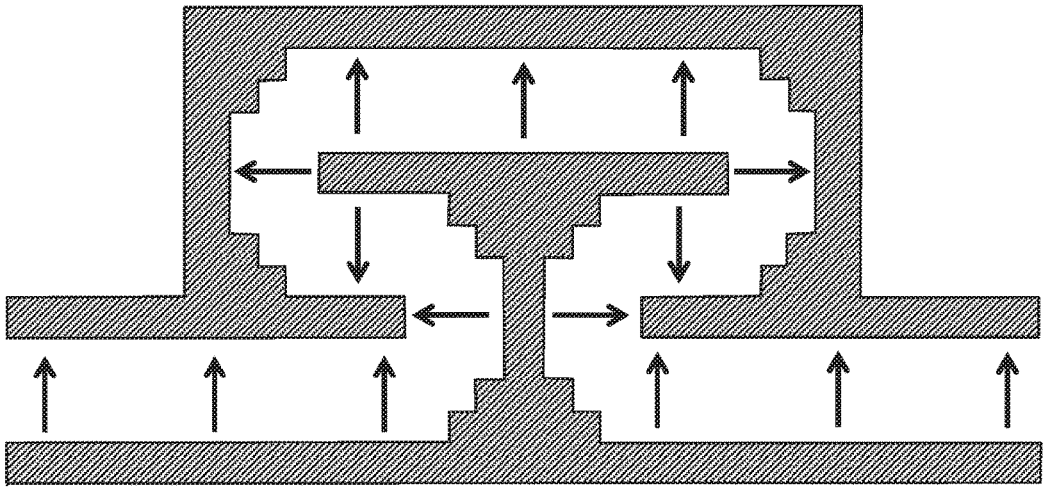

Moreover, to improve the matching of the transmission line at the level of the protuberance and increase the bandwidth, it is also possible to add matching stubs 25 to the protuberance 13, the matching stubs consisting of waveguide portions fashioned symmetrically in the external metal wall 22 of the protuberance 20, on either side of the metal insert 21. The stubs have a transversely variable profile, varying as a function of the profile of the protuberance 13. Alternatively, instead of adding stubs, the matching of the transmission line at the level of the protuberance can also be improved by replacing the 90°-angle corners, situated at the base of the insert and at the upper end of the protuberance and corresponding to changes of direction of the transmission line, with bevelled transitions or with staircase-like transitions 30 as represented for example in FIGS. 5*a*, 5*b*, 5*c*.

Figure 6A:
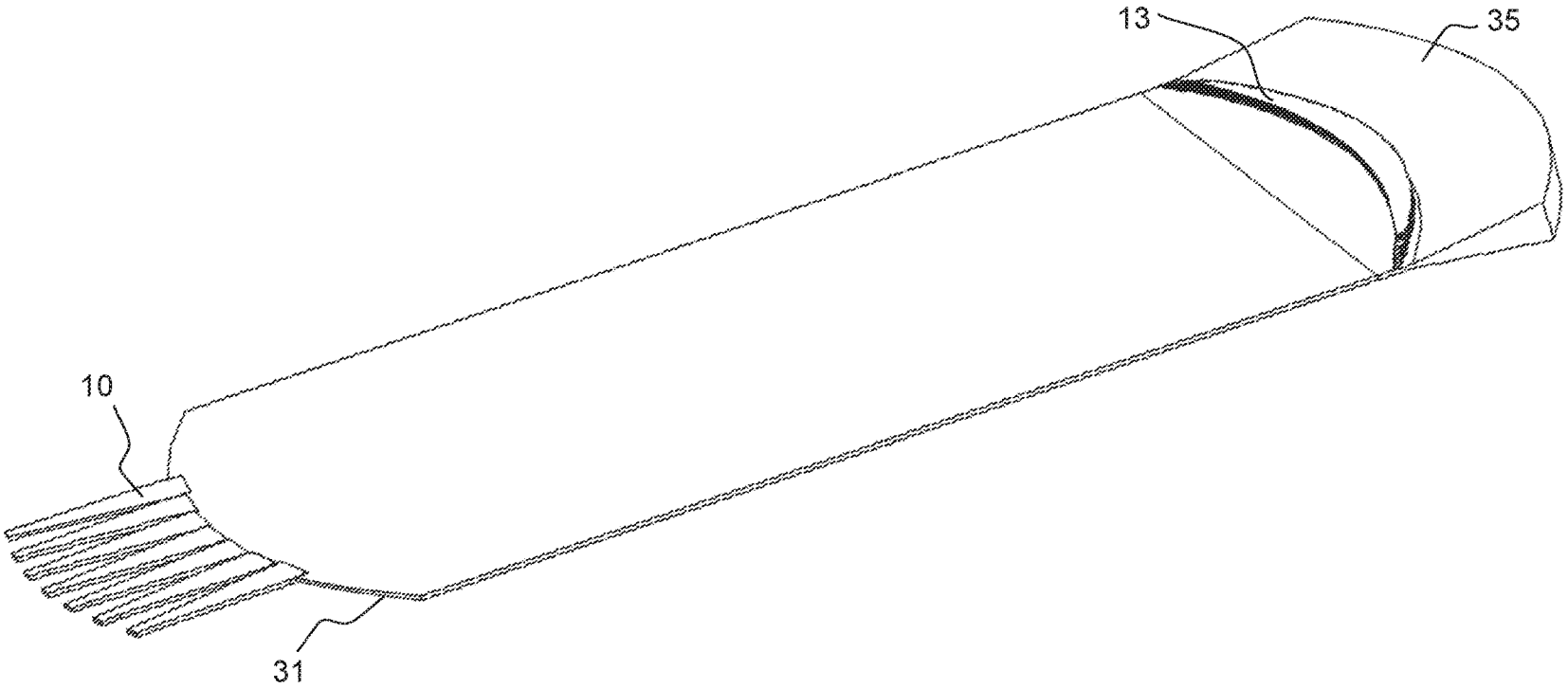
FIGS. 6*a* and 6*b*: two diagrams, respectively in perspective and viewed from above, of an exemplary multibeam antenna comprising a beamformer with lens, furnished with a protuberance with curvilinear profile, according to the invention.
Figure 6B:
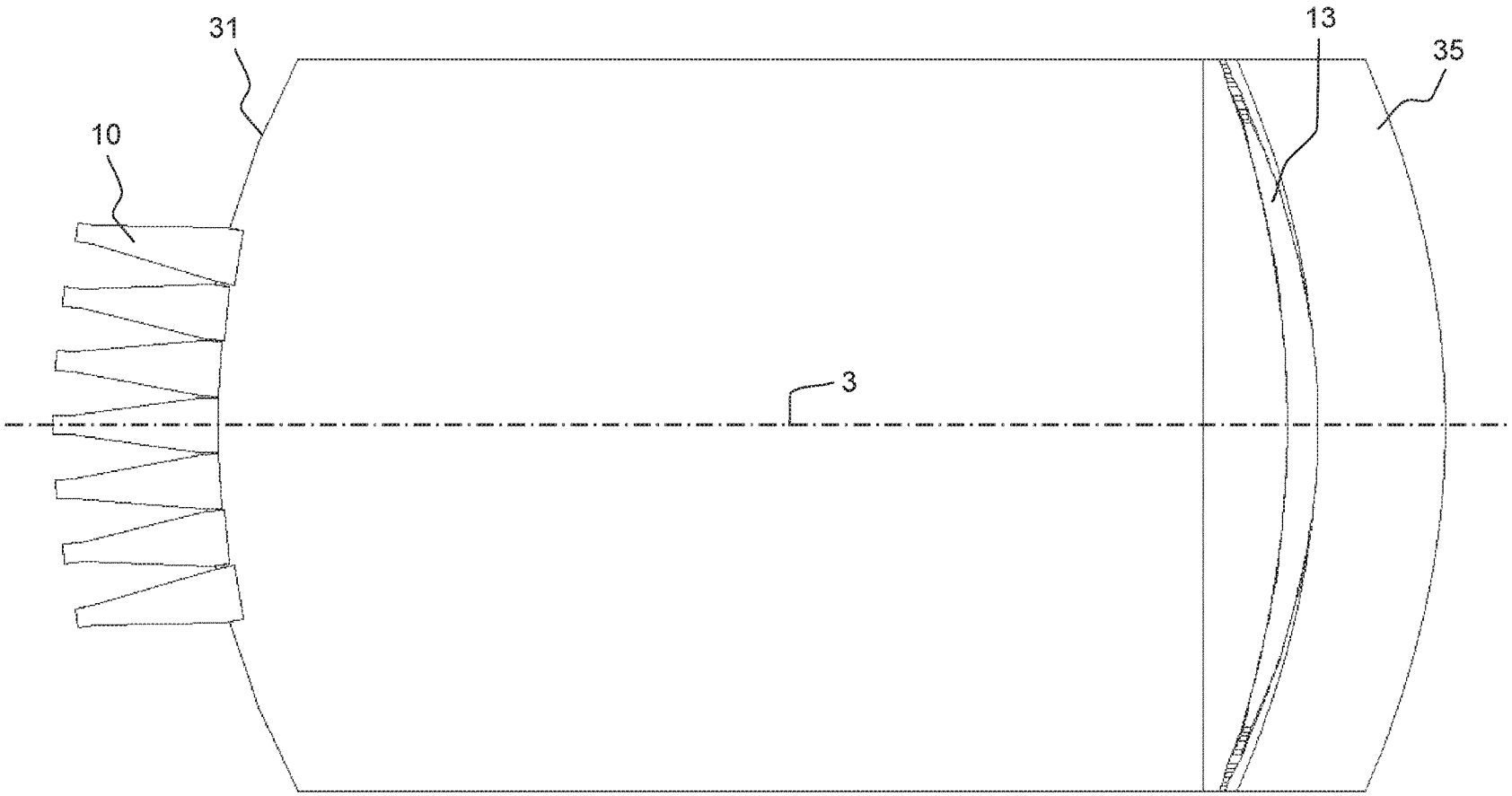

The protuberance 13 and the insert 21, placed on an output edge of the lens, can have a plane-shaped profile in the directions X and Y, as represented in FIGS. 1 and 2, or comprise a curvilinear-shaped profile in the directions X and Y, for example parabolic as represented in FIGS. 6*a* and 6*b*.

Likewise, the transmission line can have a linear input profile as in FIG. 1 or a curvilinear input profile. In FIGS. 6*a* and 6*b*, the transmission line comprises several input feed sources 10 distributed periodically around an input edge 31 of the lens according to a focal curve, for example a focal arc, centred on a median longitudinal axis 3 of the lens. Curvilinear profiles at input and at output of the lens make it possible to obtain several different focal points and to form beams over a wider angular sector.

Figure 9:
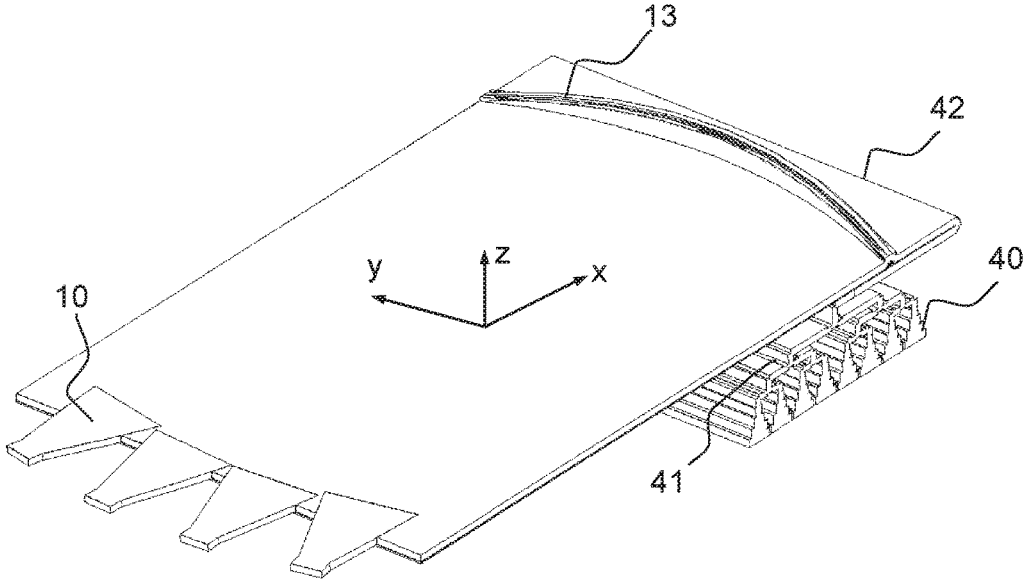
FIG. 9: a diagram in perspective, of an exemplary multibeam antenna comprising a beamformer with progressive-delays lens, furnished with a transmission line folded back on itself, according to the invention.
Figure 10:
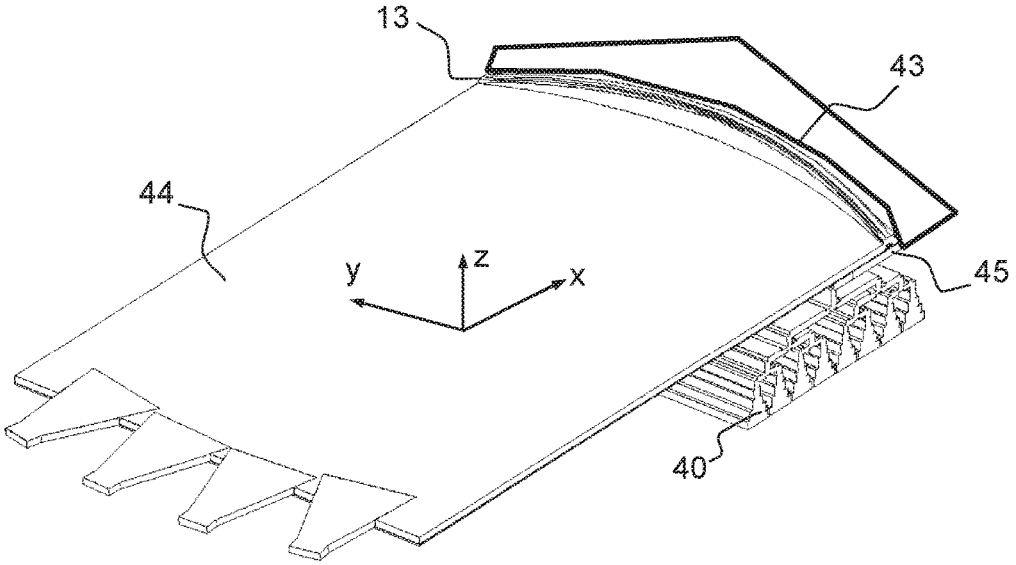
FIG. 10: a diagram in perspective, of an exemplary multibeam antenna comprising a beamformer with progressive-delays lens, furnished with a reflector wall, according to the invention.

In contradistinction to the constrained lens, the electromagnetic wave at the output of the beamformer is not spatially quantized, and in contradistinction to a Pillbox former, the foldback of the transmission line is not indispensable. The beamformer with lens in accordance with the invention applies a continuous and progressively transversely modulated delay to the incident wave. By virtue of this continuity of spatial transmission, to obtain a plane antenna, it is possible, at the output of the lens, to connect the beamformer to a linear horn 35 extending transversely over the whole width of the waveguide, as represented in FIGS. 6*a* and 6*b*, or to an array of linear apertures extending transversely over the whole width of the waveguide as represented in FIGS. 9 and 10. These continuous linear apertures exhibit the advantage of radiating the energy over the whole width of aperture of the beamformer, thereby making it possible to produce an antenna with large operating bandwidth and with a great capacity to squint the formed beam and making it possible to circumvent array lobes. The shape of the walls of the linear horn can be curvilinear as in FIGS. 6*a*, 6*b*, 7 and 8*a*.

Figure 7:
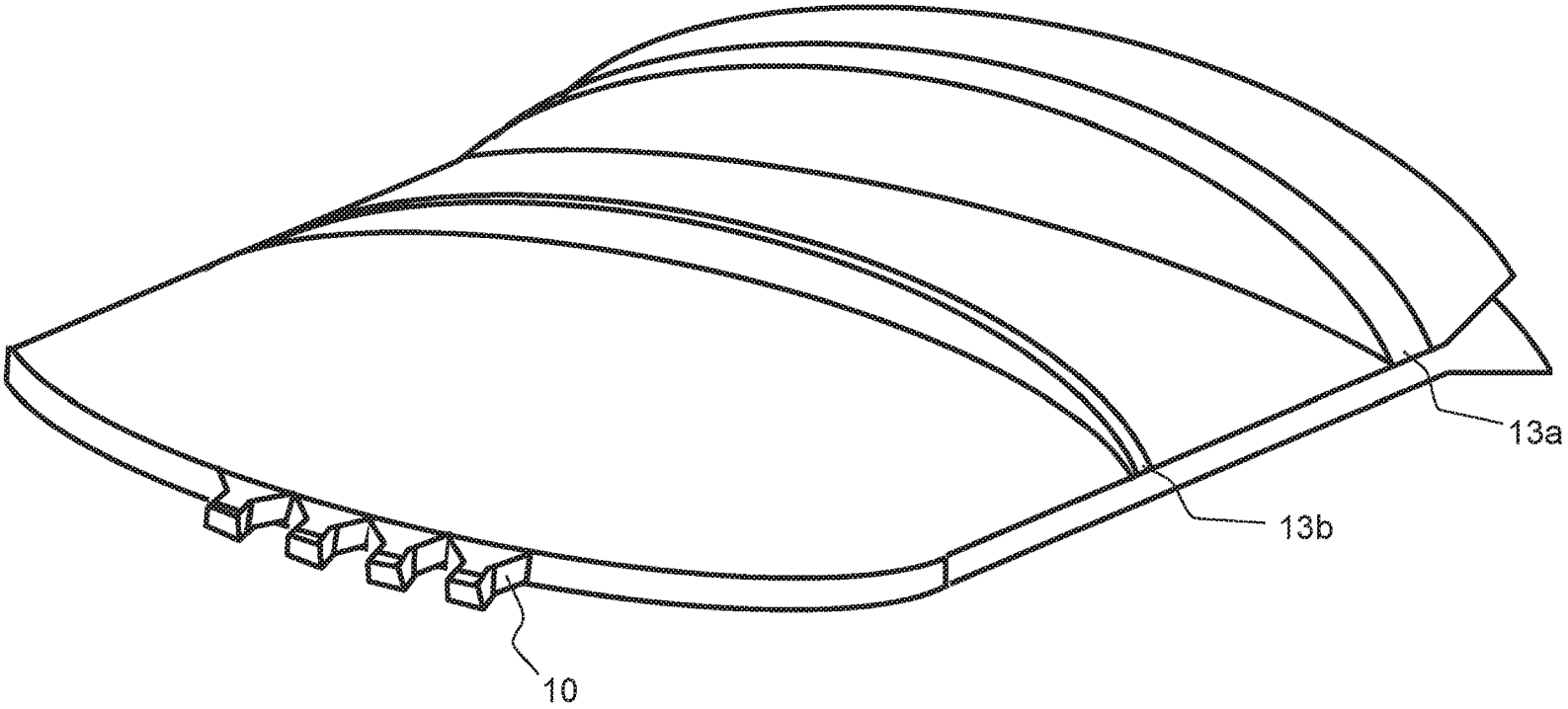
FIG. 7: a perspective diagram of an exemplary multibeam antenna comprising a beamformer with lens, furnished with two protuberances, according to the invention.
Figure 8A:
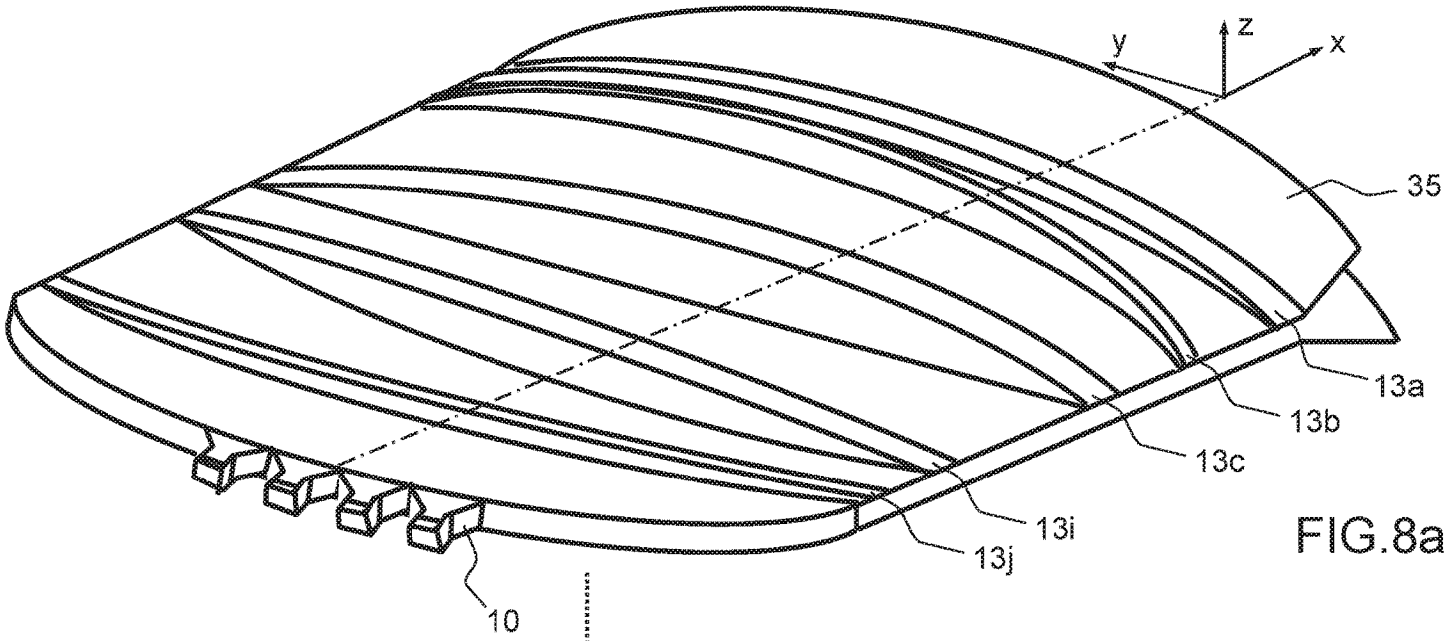
FIGS. 8*a* and 8*b*: two diagrams, respectively in perspective and in longitudinal section, of an exemplary multibeam antenna comprising a beamformer with progressive-delays lens, furnished with several protuberances with curvilinear profile and with gradient of delays, according to the invention.

To produce the propagation delays for all the propagation paths, the beamformer with lens can comprise a single protuberance furnished with a metal insert able to produce progressive delays or several protuberances distributed along the longitudinal axis X of the transmission line, at various distances from the input feed sources 10, as represented for example in FIGS. 7 and 8*a*. Each protuberance 13*a*, 13*b*, 13*c*, 13*i*, 13*n* extends height-wise in the direction Z orthogonal to the plane XY of the metal plates and comprises a metal insert, the length of whose contour, in longitudinal section, varies progressively from the centre of the lens, situated on the median longitudinal axis, up to the lateral edges of the lens. The multiplicity of protuberances makes it possible to distribute, between the various protuberances, the delays to be produced for each propagation path 1, 2, 3, each protuberance producing a fraction of the various respective delays. This makes it possible to decrease the amplitude of the delays produced by each protuberance, to decrease the length dL1, dL2, dL3 of the transmission line, in each protuberance, in the direction Z and to decrease the height of the beamformer in the direction Z.

Figure 8B:
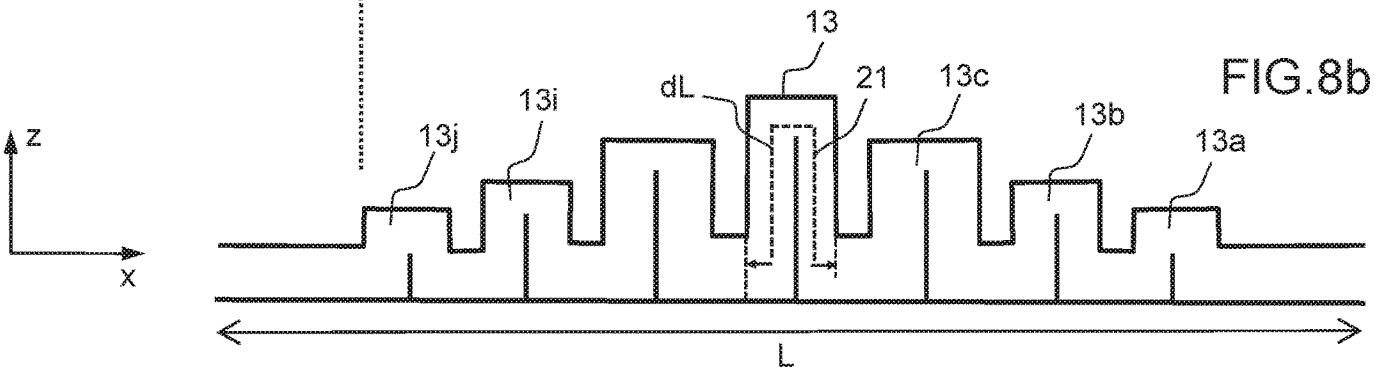

The fraction of the delays which is produced by each protuberance can be identical for all the protuberances or can vary as a function of the respective distance between each protuberance and the input feed sources 10 so as to obtain a gradient of delays in the longitudinal direction X of the transmission line. Thus, as represented in the diagram, in longitudinal section, of FIG. 8*b*, by splitting the delays over seven successive longitudinally distributed protuberances, it is possible to produce a gradient of delays in the longitudinal direction X. In the example of FIG. 8*b*, the height of the insert in the direction Z, in the various successive protuberances, varies progressively along the longitudinal axis X of the transmission line. Thus, the length dL of the transmission line, around the insert, in each protuberance 13, increases between the first four protuberances closest to the input feed sources 10, and then decreases over the last three protuberances closest to the linear output horn 35. Consequently, the delay produced by each protuberance being proportional to the length dL of the transmission line in the protuberance, the fraction of the delays which is produced by each protuberance varies in the same sense and increases between the first four protuberances closest to the input feed sources 10, and then decreases over the last three protuberances closest to the linear output horn 35.

The lens thus produced makes it possible by virtue of each protuberance to obtain a delay that varies progressively and continuously over the whole transverse width of the lens and by virtue of the splitting of the delays over several successive protuberances, makes it possible to obtain a gradient of delays in the longitudinal direction. In the longitudinal direction, the lens then behaves as a gradient-index lens. The value of the index in each protuberance, in the longitudinal direction, is equal to (L+dL)/L, where L is the length of the transmission line in the longitudinal direction X, and dL is the length of the transmission line around the insert 21, in the corresponding protuberance 13.

By controlling the index gradient, or the delay gradient, it is thus possible to reduce the aberrations, for squinted beams, over a wide angular sector. This also makes it possible to increase the number of degrees of freedom and of focusing points.

By controlling the delay gradient longitudinally as well as transversely, the beamformer can form beams without aberrations using transmission lines having a reduced length between the input feed sources and the radiating output aperture.

To improve the angular squint sector of the formed beam, it is also possible, in one and the same transmission line, to fashion several successive protuberances, corresponding alternately to convergent lenses and then to divergent lenses.

In the diagrams of FIGS. 6*a* and 6*b*, a single linear radiating horn is connected at output of the transverse protuberance of the continuous-delay lens. The continuous-delay lens can also be used to feed an array of several linear radiating horns, like the antenna represented in the diagram of FIG. 9. Therefore, at the output of the protuberance 13, the parallel-plates transmission line is folded back on itself, and comprises a linear output aperture linked to the array of radiating horns 40 by way of power dividers 41. In this case, the foldback of the transmission line is produced according to a straight line 42. The foldback may be total at 180° or partial and form an angle of between 0 and 180°.

Figure 11:
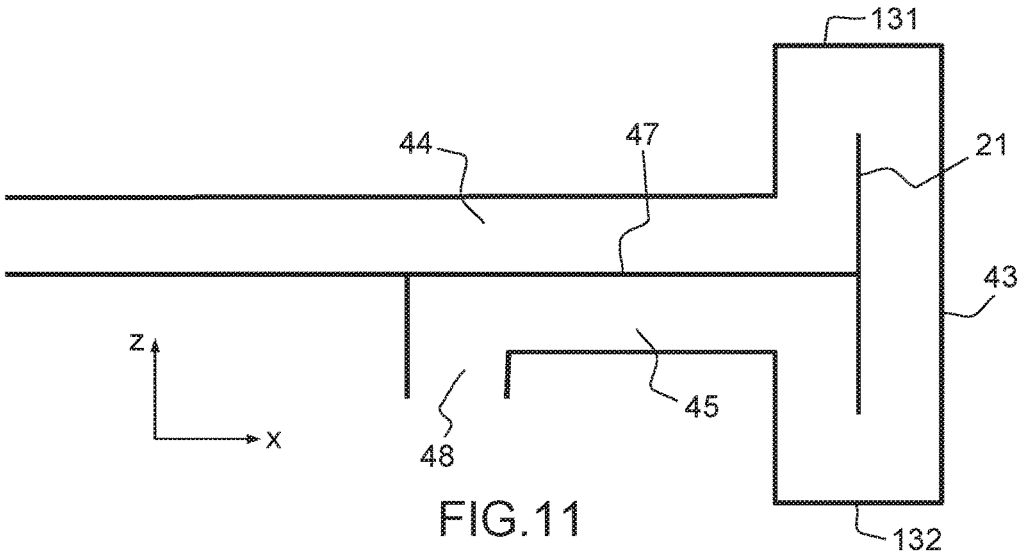
FIGS. 11 and 12: two longitudinal sectional diagrams of a beamformer with progressive-delays lens, furnished with a reflector wall, according to the invention.
Figure 12:
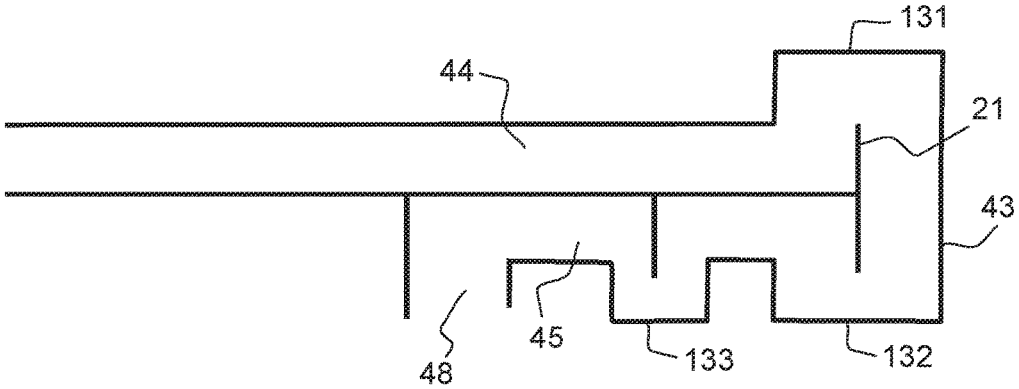

Alternatively, it is also possible to produce the foldback of the transmission line with a fold of curvilinear shape, for example of parabolic shape, by inserting, into the transmission line, a reflector wall 43, made for example of metal, extending in the direction Z, as represented for example in the diagrams of FIGS. 10, 11, 12. In this case, the beamformer consists of two stacked layers 44, 45, that are closed at one end by the reflector wall 43 which extends transversely, in the two layers of the beamformer, over the whole width and over the whole height of the transmission line. The reflector wall can be of any shape, for example plane or parabolic. The beamformer comprises at least one progressive-delays lens fed at the input by one or more feed sources 10 in accordance with the invention, and comprises a linear output aperture 48. The progressive-delays lens can be placed upstream or downstream of the reflector wall, or can be combined with the reflector wall to form an integrated assembly. In each protuberance, the metal insert can be of any shape and can extend height-wise in the direction Z and/or thickness-wise in the direction X. The linear output aperture 48 can be connected to a linear radiating horn 35 or to an array of several linear horns 40.

The protuberance or protuberances 13, 13*a*, 13*b*, 13*c* producing the progressive and continuous delays of the delay lenses can be fashioned equally in the first or the second layer, or in both layers of the beamformer. In the perspective diagram of FIG. 10, a single transverse protuberance 13 is fashioned in the first layer 44 of the beamformer, upstream of the reflector wall 43. In the longitudinal sectional diagram of FIG. 11, two opposite protuberances 131, 132 are fashioned around a metal insert 21 extending in the two layers 44, 45 of the beamformer and the reflector wall 43 is integrated into the two opposite protuberances 131, 132. In FIG. 11, the metal insert extends in the direction Z, parallel to the reflector wall 43, but of course, alternatively, it could extend thickness-wise in the direction X. Moreover, in the diagram of FIG. 11, the shapes of the metal insert in the two layers are symmetric, but this is not obligatory. The shapes of the metal insert in each protuberance and in each layer of the beamformer may differ from one another.

In the longitudinal sectional diagram of FIG. 12, the beamformer comprises two transverse protuberances 131, 132 combined with the reflector wall 43 and fashioned around a metal insert 21 extending in the two layers of the beamformer and furthermore comprises at least one third transverse protuberance 133 fashioned downstream of the reflector 43, in the second layer of the beamformer, between the reflector wall 43 and the linear output aperture 48. The radiofrequency waves emitted in the first layer at the input of the transmission line are delayed in the various protuberances of the continuous-delays lenses and reflected, by the reflector wall, towards the second layer before being radiated by the linear output horn or by the array of linear output horns. The combination of a continuous-delays-lens beamformer with a reflector wall exhibits the advantage of increasing the number of degrees of freedom, the number of focusing points and of improving the performance of the lens. The number of reflector walls can of course be greater than one, the protuberances can be situated upstream or downstream of the reflector wall or walls, and the reflector walls may or may not be integrated into protuberances.

Figure 13:
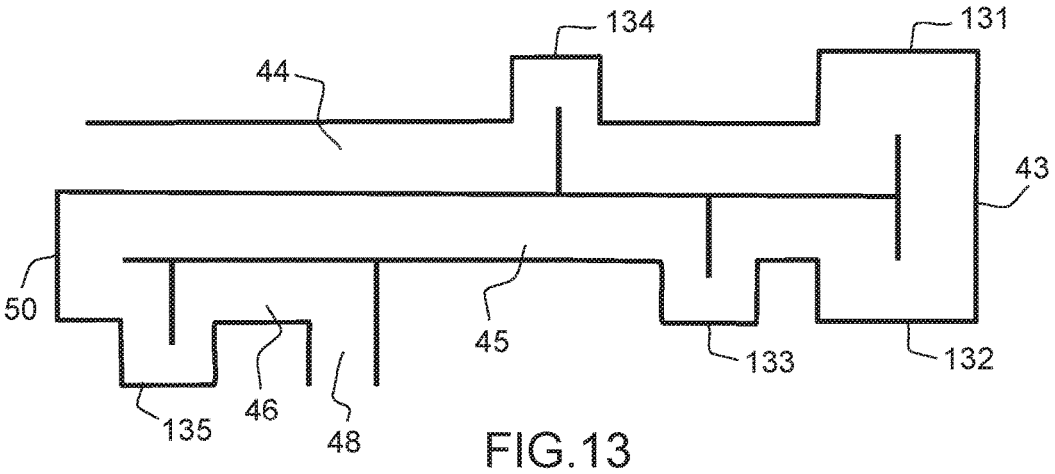
FIG. 13: a diagram, in longitudinal section, of a beamformer with progressive-delays lens, furnished with two reflector walls, according to the invention.

In the diagram of FIG. 13, the beamformer comprises several protuberances 131, 132, 133, 134, 135 and two successive reflector walls 43, 50. The first reflector wall 43 is integrated into the two opposite protuberances 131, 132, the third protuberance 133 is fashioned downstream of the first reflector wall 43, between the first reflector wall 43 and the second reflector wall 50, the fourth protuberance 134 is fashioned upstream of the first reflector wall 43, and finally the fifth protuberance 135 is fashioned between the second reflector wall 50 and a linear output aperture 48. The beamformer then comprises three stacked layers 44, 45, 46. The first reflector wall 43 extends in the first and second layers whilst the second reflector wall 50 extends in the second and third layers. The transmission line is then folded back on itself twice, by way of the first reflector wall 43, and then by way of the second reflector wall 50.

To reduce the vertical bulkiness, and avoid the excitation of higher modes at the level of the protuberances, and especially when the latter are folded back, the separation between the parallel plates must be reduced at the level of the protuberances, so as typically to be less than a quarter of the wavelength corresponding to the highest frequency, from among all the guided radiofrequency waves, in such a way that only the TEM mode can propagate. To reduce the losses of the transmission line, the separation distance must on the contrary be a maximum. It is thus possible to vary the separation distance progressively from the input feed sources 10 up to the protuberances 13.

The beamformer specifically described makes it possible to form a single line of beams in a single plane XY since all the feed sources are situated in the plane XY. Of course, it is possible to stack several identical beamformers, in accordance with the invention, to form several different lines of beams.

Likewise, it is possible to form beams in two orthogonal planes by using two identical beamformers, in accordance with the invention, connected orthogonally to one another by their respective input/output ports.

It is also possible to form beams in two orthogonal planes, by combining the planar beamformer in accordance with the invention, with different planar beamformers, able to form beams in a plane orthogonal to the plane XY, such as for example a Butler matrix.

Although the invention has been described in conjunction with particular embodiments, it is very obvious that it is in no way limited thereto and that it comprises all the technical equivalents of the means described as well as their combinations if the latter enter within the framework of the invention. In particular, the shape of the protuberance and the shape of the insert can be different from the shapes explicitly described. To vary the delay between the two lateral edges of the lens, corresponding to a variation in the length of the transmission line, the dimensions of the insert can vary height-wise in the direction Z, or thickness-wise in the direction X, or vary both height-wise and thickness-wise. Moreover, to decrease the thickness of the beamformer in the direction Z, the insert can comprise various types of foldback and/or a number of foldbacks greater than two, or a combination of several types of foldbacks. Likewise, the number of protuberance can be greater than one, the shape of the reflector can be arbitrary and the number of reflectors used can be greater than one. The protuberances can be placed upstream or downstream of a reflector wall. The beamformer can also comprise a reflector wall integrated into two protuberances. When the beamformer comprises two reflector walls, one or more protuberances can be fashioned between the two reflector walls.

The invention claimed is:

1. A quasi-optical beamformer with lens comprising a radiofrequency transmission line fed at a first end, by at least one input feed source, the transmission line comprising two stacked metal plates, spaced apart and extending in two directions, longitudinal X and transverse Y, wherein the transmission line further comprises at least one protuberance extending in the directions X, Y, and in a direction Z orthogonal to the plane XY, the protuberance comprising a metal insert extending in the direction X, in the transverse direction Y between two lateral edges of the transmission line, and extending height-wise in the direction Z, the metal insert comprising a base fastened to one of the two metal plates and at least one free end and having, in longitudinal section, a contour of variable length between the two lateral edges of the transmission line, and wherein, in the protuberance, the transmission line is adjoining the metal insert and forms, in the direction Z, a circumvolution around the metal insert.

2. The quasi-optical beamformer with lens according to claim 1, wherein the free end of the metal insert is folded back parallel to the XY plane.

3. The quasi-optical beamformer with lens according to claim 2, wherein the free end of the metal insert is doubly folded back in a T shape, parallel to the XY plane.

4. The quasi-optical beamformer with lens according to claim 1, wherein the protuberance and the metal insert have profiles of curvilinear shapes in the directions X and Y.

5. The quasi-optical beamformer with lens according to claim 4, wherein the protuberance has an input profile and an output profile of different shapes.

6. The quasi-optical beamformer with lens according to claim 1, wherein the protuberance comprises matching stubs.

7. The quasi-optical beamformer with lens according to claim 1, wherein, in the protuberance, the metal plates of the transmission line have an internal face comprising staircase-like transitions.

8. The quasi-optical beamformer with lens according to claim 1, wherein the length of the contour, in longitudinal section, of the metal insert decreases progressively from the centre to the two lateral edges of the transmission line.

9. The quasi-optical beamformer with lens according to claim 8, wherein the metal insert comprises a symmetric profile with respect to a median longitudinal axis of the transmission line.

10. The quasi-optical beamformer with lens according to claim 1, wherein the length of the contour, in longitudinal section, of the metal insert increases progressively from the centre to the two lateral edges of the transmission line.

11. The quasi-optical beamformer with lens according to claim 10, wherein the metal insert comprises a symmetric profile with respect to a median longitudinal axis of the transmission line.

12. The quasi-optical beamformer with lens according to claim 1, wherein the transmission line comprises several input feed sources distributed periodically, around an input edge, according to a focal curve.

13. The quasi-optical beamformer with lens according to claim 1, wherein the transmission line comprises several protuberances able to produce progressive delays, the protuberances being distributed successively along the longitudinal axis X of the transmission line, at various distances from the input feed sources, each protuberance comprising a metal insert, the length of whose contour, in longitudinal section, varies between the two lateral edges of the transmission line.

14. The quasi-optical beamformer with lens according to claim 13, wherein the length of the contour of the metal inserts, in the various successive protuberances, varies progressively from one protuberance to another adjacent protuberance, in the longitudinal direction X of the transmission line.

15. The quasi-optical beamformer with lens according to claim 1, wherein the transmission line is folded back on itself in the direction X, according to a fold of straight shape.

16. The quasi-optical beamformer with lens according to claim 1, further comprising at least one first reflector wall extending transversely in the transmission line, and orthogonally to the metal plates in the direction Z, the first reflector wall being able to fold the transmission line, back on itself, in the direction X, according to a fold of curvilinear shape.

17. The quasi-optical beamformer with lens according to claim 16, comprising at least two stacked layers, respectively first and second layers, closed at one end by the first reflector wall and two opposite protuberances fashioned around a metal insert extending in the two stacked layers, the first reflector wall being integrated into the two opposite protuberances.

18. The quasi-optical beamformer with lens according to claim 17, further comprising a third layer stacked on the second layer and a second reflector wall extending in the second and third layers.

19. The quasi-optical beamformer with lens according to claim 16, further comprising at least one third protuberance fashioned in the second layer downstream of the first reflector wall.

20. A plane antenna comprising at least one beamformer according to claim 1 and further comprising a linear radiating horn connected at output of the beamformer.

21. The plane antenna comprising at least one beamformer according to claim 1, wherein the transmission line is folded back, on itself, in the direction X, and further comprises a linear output aperture linked to an array of several radiating horns.

* * * * *